United States Patent [19]

McFarland

[11] Patent Number: 4,772,164

[45] Date of Patent: Sep. 20, 1988

[54] CLAMPING MECHANISM

[76] Inventor: Robert E. McFarland, 8301 NW. 39th Expressway, Oklahoma City, Okla. 73008

[21] Appl. No.: 901,252

[22] Filed: Aug. 28, 1986

Related U.S. Application Data

[60] Continuation-in-part of Ser. No. 792,874, Oct. 30, 1985, Pat. No. 4,658,971, which is a division of Ser. No. 565,164, Dec. 23, 1983, Pat. No. 4,573,854.

[51] Int. Cl.[4] ..... B61D 3/18

[52] U.S. Cl. ..... 410/3; 410/51; 414/462; 414/720; 414/728; 414/921; 224/42.44; 267/174; 267/179

[58] Field of Search ..... 414/462, 522, 549, 719, 414/720, 728, 921; 410/3, 4, 51; 267/167, 168, 170, 174, 178, 179; 187/35, 36, 67; 269/94, 229, 230

[56] References Cited

U.S. PATENT DOCUMENTS

| | | | |
|---|---|---|---|
| Re. 31,178 | 3/1983 | Deacon | 414/546 |
| 1,497,213 | 6/1924 | Jurczyk | 269/230 |
| 1,619,044 | 3/1927 | Scherer . | |
| 1,665,247 | 4/1928 | Young | 269/230 |
| 2,545,668 | 3/1951 | Merriman | 269/94 |
| 3,011,669 | 12/1961 | Sylvester | 214/450 |
| 3,193,899 | 7/1965 | Johnson | 24/241 |
| 3,800,967 | 4/1974 | Kosecoff | 214/450 |
| 3,843,001 | 10/1974 | Willis | 214/450 |
| 3,937,376 | 2/1976 | Ewing | 224/42.08 |
| 4,019,752 | 4/1977 | Leon et al. | 410/4 |
| 4,032,167 | 6/1977 | Chereda | 280/106 T |
| 4,039,096 | 8/1977 | McAllister | 414/462 |
| 4,073,395 | 2/1978 | Clement | 214/450 |
| 4,093,303 | 6/1978 | Nelson | 410/4 |
| 4,127,200 | 11/1978 | Mann | 214/75 H |
| 4,213,729 | 7/1980 | Cowles et al. | 414/462 |
| 4,236,860 | 12/1980 | Gottlieb et al. | 414/462 |
| 4,251,178 | 2/1981 | Bourgraf et al. | 414/343 |
| 4,273,498 | 6/1981 | Dickhart, III et al. | 414/556 |
| 4,297,069 | 10/1981 | Worthington | 414/462 |
| 4,369,995 | 1/1983 | Harper | 410/51 |
| 4,376,611 | 3/1983 | Koop | 414/462 |
| 4,400,129 | 8/1983 | Eisenberg et al. | 414/462 |
| 4,407,624 | 10/1983 | Kingston | 414/546 |
| 4,411,580 | 10/1983 | Kelly | 414/462 |
| 4,475,762 | 10/1984 | DeLong et al. | 296/65 R |
| 4,479,752 | 10/1984 | Todd | 414/462 |
| 4,671,713 | 6/1987 | Lenkman | 410/51 |

*Primary Examiner*—Joseph F. Peters, Jr.
*Assistant Examiner*—Stephen P. Avila
*Attorney, Agent, or Firm*—Laney, Dougherty, Hessin & Beavers

[57] ABSTRACT

A clamping mechanism for clamping an object to a structural member. The clamping mechanism is particularly adapted for clamping a wheelchair wheel to a loading rack of a wheelchair loader. The clamping mechanism comprises a mounting bracket used for attachment to the structure, such as the wheelchair loading rack, and has a pivot pin fixedly attached thereto. Pivotally mounted with respect to the pivot pin is a handle assembly including a hollow handle with a spring biased actuation plate positioned therein. An actuation button is attached to the plate. The pivot pin extends through a transverse hole in the handle and has a key portion which lockably engages a keyway in the actuation plate. By depressing the actuation button, the keyway in the plate is moved with respect to the key on the pivot pin to an unlocked position so that the handle assembly may be pivoted. A clamp assembly is pivotally attached to the mounting bracket and interconnected with the handle by a pair of links such that as the handle is pivoted between locked and unlocked positions, the clamp assembly is moved from a clamping position to an unclamped position. A resilient ring is disposed between a head portion of the pivot pin and the handle assembly to act as a friction clutch for preventing undesired movement of the handle assembly. A wheelchair loading rack utilizing the clamping mechanism is also disclosed.

26 Claims, 3 Drawing Sheets

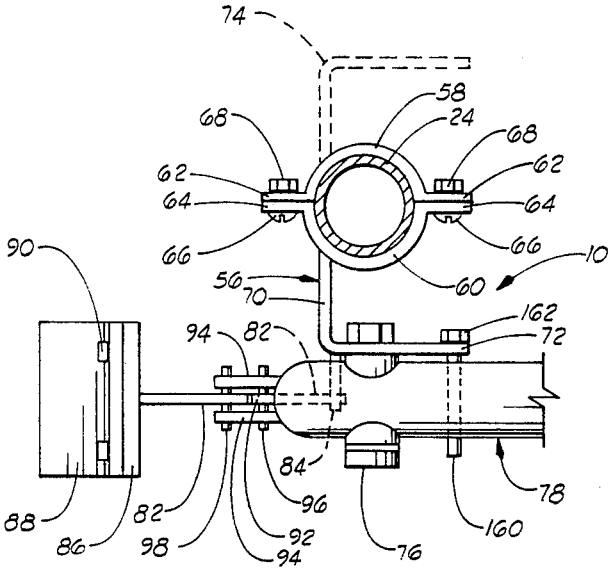
FIG. 5
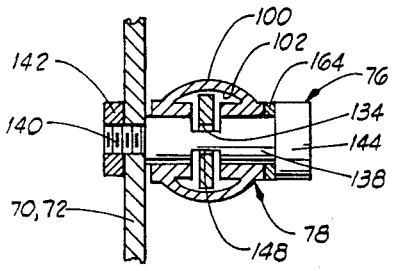
FIG. 6
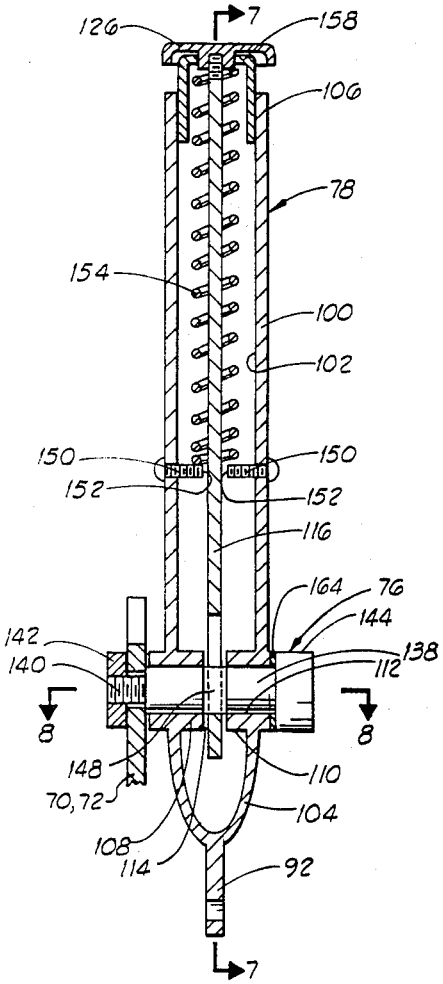
FIG. 8
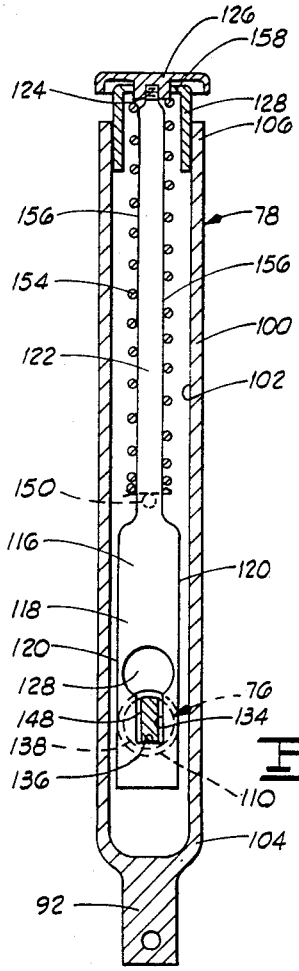
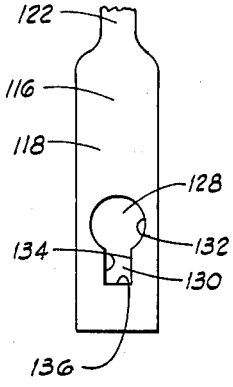
FIG. 7A
FIG. 7

CLAMPING MECHANISM

This is a continuation-in-part of U. S. patent application Ser. No. 792,874, filed Oct. 30, 1985, now U.S. Patent No. 4,658,971, which is a division of U. S. patent application Ser. No. 565,164, filed Dec. 23, 1983, now U. S. Pat. No. 4,573,854.

Background Of The Invention

1. Field Of The Invention

This invention relates to clamping mechanisms, and more particularly to a clamping mechanism used for clamping an object, such as a wheelchair wheel, to a structural member, such as a wheelchair loading rack on a wheelchair loader.

2. Description Of The Prior Art

In loading an object, such as a wheelchair, onto a structural member, such as a loading rack of a wheelchair loader used in loading the wheelchair into a vehicle, it is desirable to clamp the object to the structure in a way in which the object will not come loose accidentally during movement of the structure.

In the particular art of wheelchair loaders, numerous devices have been developed for securing the wheelchair to the loader during the loading operation and during transit. Typical examples of such devices are disclosed in U.S. Pat. No. 3,937,376 to Ewing; U.S. Pat. No. 4,073,395 to Clement; U.S. Pat. No. 4,213,729 to Cowles et al.; U.S. Pat. No. 4,297,069 to Worthington; and U.S. Pat. No. 4,400,129 to Eisenberg et al. Each of these devices provides, with varying degrees of success, clamping means for holding the wheelchair to the loader. However, many of these require difficult and complex operations, which can be a particular problem for handicapped persons. Also, in at least some of these prior art devices, the wheelchair can easily become dislodged from the loader during transit, resulting in undesired movement of the wheelchair with the possibility of damage thereto or danger to passengers in the vehicle.

Therefore, there is a need for a clamping device having simple movement requiring little dexterity so that it can be operated by at least some handicapped persons, while still rigidly clamping the wheelchair to the loader. The clamping mechanism of the present invention solves this problem by providing quick release clamping of the wheelchair, but which is not accidentally dislodged easily, even by attempted movement of the actuating handle thereof unless an actuating button is depressed.

Clamping mechanisms are also used for wheelchair brakes, and the present apparatus can easily be adapted to such a usage, thereby providing a quick release brake which is lockable so it is not accidentally disengageable as with most prior known brakes.

Of course, quick release clamping mechanisms are used in many other areas, such as clamping an object to a machine tool for machining work thereon. One such clamping device is disclosed in U.S. Pat. No. 2,545,668 to Merriman. The apparatus of the present invention is further easily adaptable for such machine tool usage, as will be seen by those skilled in the art.

SUMMARY OF THE INVENTION

The clamping mechanism of the present invention provides a quickly releasing, lockable means for clamping an object to a structural member. The clamping mechanism is particularly adaptable for use in clamping a wheel of a wheelchair to a wheelchair loading rack, but is not limited to such usage.

The clamping mechanism comprises mounting means for attaching to the structure, pivot means attached to the mounting means, lever or handle means pivotally mounted on the pivot means, object engaging means pivotally attached to the mounting means, and linkage means interconnecting the lever or handle means and the object engaging means. One of the pivot means and lever means comprises key means thereon, and the other of the pivot means and lever means comprises keyway means thereon, wherein one of the key means and keyway means is movable with respect to the other between a locked position and an unlocked position allowing relative rotation therebetween such that the lever means may be pivoted between first and second positions. As the lever means is pivoted between the first and second positions, the linkage means acts to pivot the object engaging means between a clamping position in which the object is engaged thereby and an unclamped position in which the object is disengaged therefrom.

Preferably, the lever or handle means comprises a hollow handle defining a transverse hole therethrough and an actuation plate reciprocably positioned in the handle wherein the keyway means is characterized by a substantially keyhole-shaped opening in a portion of the plate adjacent the transverse hole. The opening has an elongated portion and an enlarged portion. The pivot means comprises a pivot pin extending through the transverse hole in the handle and is fixedly attached to the mounting means. The key means is characterized by a flat surface on the pivot pin. The flat surface engages the elongated portion of the opening in the actuation plate when in the locked position and is disposed in an enlarged portion of the opening when in the unlocked position.

Biasing means are provided for biasing the movable one of the key means and keyway means toward the locked position. In the preferred embodiment, the biasing means is a spring which biases the plate in a direction away from the transverse hole in the handle.

The clamping mechanism further comprises friction clutch means in operative association with the lever means and pivot means for providing frictional resistance therebetween as the lever means is pivoted. In the preferred embodiment, the friction clutch means is characterized by a resilient ring disposed between the handle and a head of the pivot pin adjacent the handle.

The object engaging means includes a clamp assembly with a clamping member and a lever portion pivotally connected to the mounting means. The linkage means is characterized by at least one link interconnecting the lever portion of the clamp assembly and an end of the handle.

In an embodiment of the clamping apparatus of the present invention for use on a wheelchair loader, the clamping mechanism is attached to a wheelchair loading rack and is used to clamp a wheel of a wheelchair to the rack. In one alternate embodiment, the clamping mechanism is angled with respect to the rack so that the clamping member is radially aligned with a center point of the wheel.

The clamping member may be adapted to fit the size and shape of any wheel, and in one embodiment includes an elongated rib thereon which provides a reduced area of contact on the wheel for increasing the securing pressure applied thereto.

An important object of the present invention is to provide a clamping mechanism for clamping an object to a structure and which is quickly actuated and lockable when in a clamping position.

Another object of the present invention is to provide a lockable clamping mechanism for clamping a wheelchair wheel to a wheelchair loading rack.

An additional object of the invention is to provide a clamping mechanism for a wheelchair loader which may be operated by at least some handicapped persons.

A further object of the invention is to provide a toggle clamping mechanism with a reciprocating locking plate in the handle thereof.

Still another object of the invention is to provide a wheelchair clamping and loading rack which lockably clamps and bears against a wheelchair wheel on both sides of the vertical and horizontal axes thereof.

Additional objects and advantages of the invention will become apparent as the following detailed description of the preferred embodiment is read in conjunction with the accompanying drawings which illustrate such preferred embodiment.

BRIEF DESCRIPTION OF THE DRAWINGS

FIG. 5 is a cross section taken along lines 5—5 in FIG. 3.

FIG. 6 is a longitudinal cross section of the actuating handle assembly of the clamping mechanism taken along lines 6—6 in FIG. 3.

FIG. 7 is a transverse cross section of the actuating lever taken along lines 7—7 in FIG. 6.

FIG. 7A illustrates a portion of the actuation plate alone as viewed in FIG. 7, including details of the aperture therethrough.

FIG. 8 is a transverse cross section taken along lines 8—8 in FIG. 6.

DESCRIPTION OF THE PREFERRED EMBODIMENT

Figure 1:
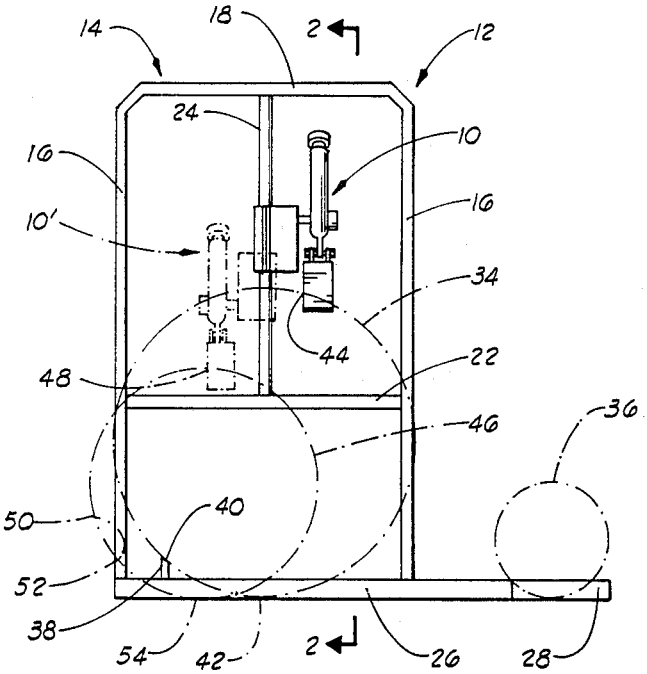
FIG. 1 illustrates the clamping mechanism of the present invention forming part of a wheelchair clamping and loading rack as viewed from the side of a wheelchair loaded thereon.
Figure 2:
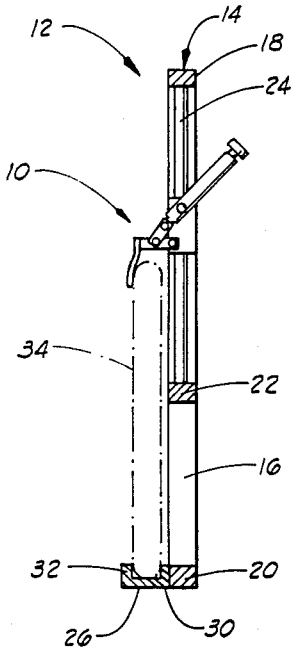
FIG. 2 is a vertical cross section taken along lines 2—2 in FIG. 1.

Referring now to the drawings, and more particularly, to FIGS. 1 and 2, the clamping mechanism of the present invention is shown and generally designated by the numeral 10 as forming part of a wheelchair clamping and loading rack 12. Rack 12 is preferably of a type used on a wheelchair loader such as disclosed in my co-pending application Ser. No. 792,874, a copy of which is incorporated herein by reference. For such a loader, FIG. 1 represents a rear view.

The main structure of rack 12 is a support frame 14 including a pair of substantially parallel vertical members 16 and top and bottom horizontal members 18 and 20, respectively. Rack 12 also preferably includes an intermediate horizontal member 22 with an intermediate vertical support member 24 extending between intermediate horizontal member 22 and top horizontal member 18. Preferably, but not by way of limitation, intermediate vertical member 24 is centrally located between vertical members 16.

A main wheel rail 26 and a front wheel rail 28 are attached to lower horizontal member 20 of frame 14, onto which are rolled the corresponding wheels on one side of a wheelchair. Vertical guides 30 and 32, such as shown for main wheel rail 26 in FIG. 2, keep main wheel 34 properly tracked on main wheel rail 26. Similar vertical guides are used to keep front wheel 36 on front wheel rail 28.

Main wheel 34 is rolled onto rail 26 until it stops against stop plate 38 at contact point 40 with the lowermost portion of wheel 34 resting on rail 26 at contact point 42. Front wheel 36 is concurrently rolled onto front wheel rail 28.

Clamping mechanism 10 prevents rotation of main wheel 34 by clamping the main wheel at a contact point 44 in a manner hereinafter described in more detail. Clamping mechanism 10 exerts a downward force on main wheel 34 when in a clamping position, while at the same time pulling the main wheel against frame 14. It will be seen that contact point 44 is on a side of a vertical center line of main wheel 34 opposite contact point 40. Further, contact point 44 is on a side of a horizontal center line of main wheel 34 opposite contact point 42. Thus, clamping mechanism 10 at contact point 44, stop plate 38 at a contact point 40 and main wheel rail 26 at contact point 42 form a three-point pattern to rigidly hold main wheel 34 to rack 12.

As will be discussed in more detail hereinafter, clamping mechanism 10 may be positioned at any point along vertical member 24 to accommodate different sized main wheels 34. Clamping mechanism 10 is illustrated on the right-hand side of vertical member 24 as viewed in FIG. 1, but the clamping mechanism may be configured to be placed on the left-hand side of vertical member 24, as generally indicated by reference numeral 10'. This might be necessary for particularly small wheels, such as wheel 46. However, clamping mechanism 10' clamps against wheel 46 at contact point 48 which is on an opposite side of the vertical center line of wheel 46 from contact point 50 where wheel 46 engages a stop plate 52. Contact point 48 is obviously on an opposite side of the horizontal center line of wheel 46 from contact point 54 on rail 26. Thus, the three-point pattern to rigidly hold wheel 46 to rack 12 is maintained, and it will be clear that any size wheel may be accommodated in this manner.

Main wheel rail 26 and front wheel rail 28 are illustrated in FIG. 1 as extending to the right of frame 14. It will be obvious to those skilled in the art that the rails could just as easily extend to the left with clamping mechanism 10 or 10' moved accordingly, depending upon the preference and requirements of the user.

Figure 3:
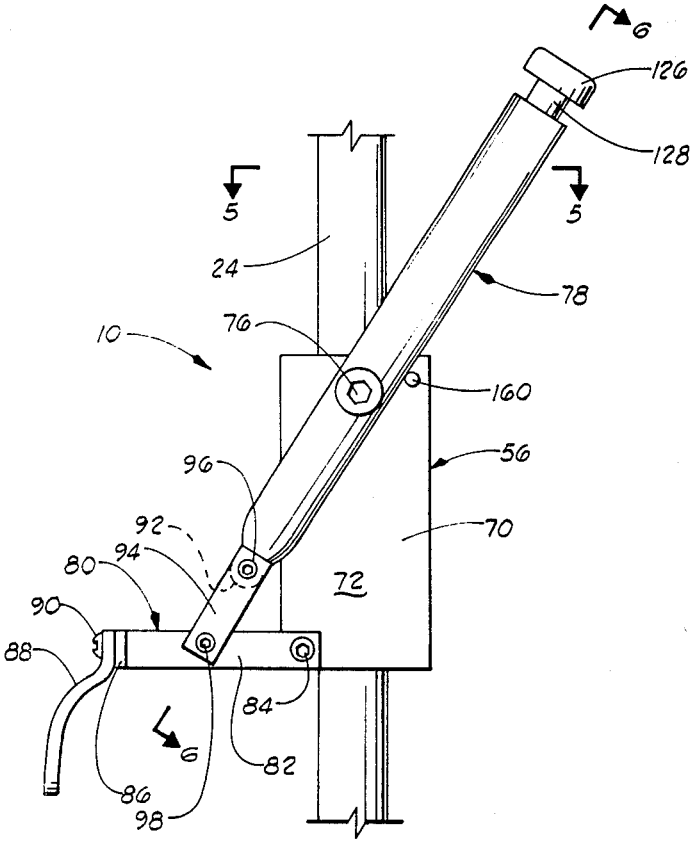
FIG. 3 is an enlarged side view of the clamping mechanism of the present invention shown in a clamping position.
Figure 4:
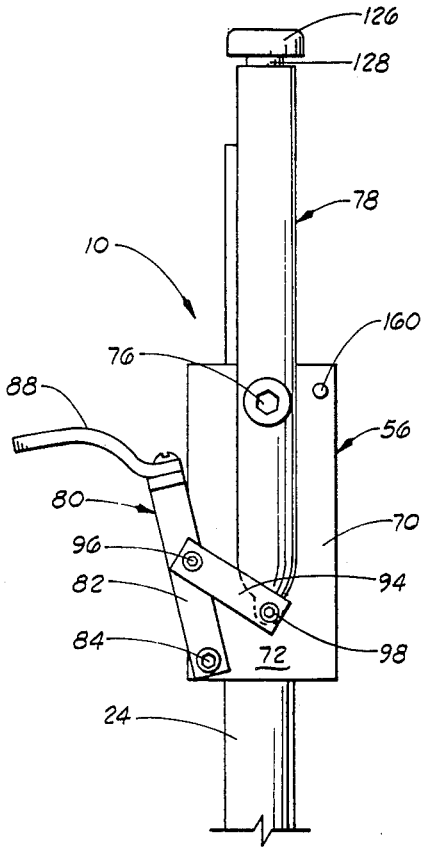
FIG. 4 is a side view of the clamping mechanism shown in a raised or free position.

Referring now to FIGS. 3–5, details of clamping mechanism 10 are shown. A mounting bracket 56 is used to hold the apparatus to intermediate vertical support member 24. As shown in FIG. 5, vertical member 24 is of cylindrical configuration, although it is not limited to this shape, and mounting bracket 56 includes a first substantially U-shaped member 58 and a second substantially U-shaped member 60 which are dimensioned to conform to an enclosed vertical member 24. First U-shaped member 58 has a pair of flanges 62 extending from opposite sides thereof, and second U-shaped member 60 has a pair of corresponding flanges 64 extending therefrom. Fastener means, such as screws 66 and nuts 68 clamp corresponding flanges 62 and 64 together such that first and second U-shaped members 58 and 60 are rigidly clamped against vertical member 24. Fixedly attached to second U-shaped member 60 is an L-shaped member 70 having a portion 72 substantially parallel to flanges 62 and 64. Thus, mounting means are provided for clamping mechanism 10.

For positioning of a clamping mechanism such as 10' on the opposite side of vertical member 24, it will be seen that alternate L-shaped member 74 could be attached to first U-shaped member 58, as hereinbefore described.

Clamping mechanism 10 also includes pivot means, such as a pivot pin 76, on which is pivotably mounted lever means, such as a lever or handle assembly 78. Pivot pin 76 and handle assembly 78 may generally be described as forming a lever and pivot assembly.

Clamping mechanism 10 further includes object engaging means, preferably in the form of a clamp assembly 80 having a lever portion 82 pivotally attached to L-shaped member 70 by pivot pin 84. Extending transversey from both sides of lever 82 are flanges 86 to which it attached a clamp plate 88 by fastening means such as screws 90.

Interconnecting lower end 92 of handle assembly 78 are linkage means, preferaably in the form of a pair of elongate links 94. Each link 94 has an end pivotally connected to lower end 92 of handle assembly 78 by a pivot pin 96 and an opposite end pivotally connected to an intermediate part of lever portion 82 by a pivot pin 98.

Referring now to FIGS. 6–8, details of handle assembly 78 and the interaction thereof with pivot pin 76 are shown. Handle assembly 78 includes an elongated, tubular handle 100 of substantially cylindrical configuration defining a central cavity 102 therein. Handle 100 has a closed end 104 of which lower end 92 forms a part and central cavity 102 opens at an opposite open end 106.

A pair of collars 108 an 110 of substantially cylindrical cross section extend transversely through handle 100 and define a transverse hole therethrough in communication with central cavity 102. At approximately the transverse center of handle 100, collars 108 and 110 are spaced apart to define a gap 114 therebetween.

Reciprocably positioned in central cavity 102 of handle 100 is a substantially flat actuation plate 116. As best seen in FIG. 7, actuation plate 116 has an enlarged first portion 118 with edges 120 in close spaced relationship to the inner surface of handle 100 defining central cavity 102. Thus, movement of plate 116 in the transverse direction shown in FIG. 7 is limited.

Plate 116 also includes a relatively narrower second portion 122 extending from enlarged portion 118 and out of open end 106 of handle 100. Preferably, narrow portion 122 has a threaded upper end 124 to which is threadingly engaged an actuation button 126. Extending from the inner surface of button 106 and into open end 106 of handle 100 is a sleeve 128.

Enlarged portion 118 of actuation plate 116 defines a substantially keyhole-shaped aperture 128 therethrough. Aperture 128 has an elongated portion 130 and an enlarged, preferably rounded portion 132. Elongated portion 130 is formed by a pair of longitudinally extending, substantially parallel side edges 134 and a bottom edge 136. The details of aperture 128 are best shown in FIG. 7A.

Actuation plate 116 is positioned in central cavity 102 of handle 100 such that a portion of aperture 128 is always aligned with transverse hole 112. It will thus be seen that part of enlarged portion 118 of actuation plate 116 extends through gap 114 between collars 108 and 110. In this way, the collars act as a plate positioning means for locating actuation plate 116 at a substantially transversely central position in central cavity 102, thus limiting the transverse movement of actuation plate 116 in the direction shown in FIG. 6.

Extending through transverse hole 112 and handle 100, and thus through aperture 128 and actuation plate 116, is a shank portion 138 of pivot pin 76. An end portion with a threaded end 140 extends from shank portion 138 beyond the outer edge of collar 100 through portion 72 of L-shaped member 70 and is fixedly attached to the L-shaped member by fastener means such as nut 142. In this way, pivot pin 76 is held stationary with respect to L-shaped member 70, and rotation with respect thereto is prevented. Pivot pin 76 also includes a head portion 144 which is adjacent the outer edge of collar 110 on an opposite side of handle 100 from L-shaped member 70.

Shank portion 138 of pivot pin 76 is of substantially cylindrical configuration, but has at least one flat surface 148 defined thereon as best shown in FIGS. 7 and 8. In the preferred embodiment, two such flat portions 148 are used, but the invention is not limited to this particular configuration. Flat portions 148 are positioned axially along shank portion 138 of pivot pin 76 such that the flat portions are in general alignment with gap 114 defined between collars 108 and 110. It will be seen that when actuation plate 116 is in the position shown in FIGS. 6–8, flat portions 148 are adjacent longitudinal edges 134 of elongated portion 130 of aperture 128. This forms a locking position of actuation plate 116, and thus of handle assembly 78, and it will be seen that the actuation plate and handle assembly cannot be pivoted with respect to pivot pin 76 when flat surfaces 148 of shank portion 138 of the pivot pin are in such locking engagement with elongated portion 130 of aperture 128.

A spring seat is positioned at a longitudinally transverse location in central cavity 102 of handle 100 between transverse hole 112 and open end 106. Preferably, the spring seat is formed by a pair of oppositely positioned pins or screws 150 which extend into the central cavity such that ends 152 thereof are adjacent actuation plate 116.

Annularly disposed around narrow portion 122 of actuation plate 116 are biasing means, such as spring 154. As seen in FIG. 7, spring 154 is closely positioned to longitudinal edges 156 of narrow portion 122 of actuation plate 116. One end of spring 154 bears against screws 150, and the other end of the spring bears against an annular shoulder 158 formed on sleeve 128. Thus, actuation plate 116, button 126 and sleeve 128 are biased away from screws 150 and thus away from transverse opening 112 of handle 100. It will be seen by those skilled in the art that bottom edge 136 of elongated portion 130 of aperture 128 in actuation plate 116 bears against shank portion 138 of pivot pin 76, limiting the movement of actuation plate 116, button 126 and sleeve 128 away from the pivot pin. Thus, the biasing means acts to maintain the apparatus in the locked position shown in FIGS. 3, 6 and 7.

By depressing button 126 toward handle 100, enlarged portion 132 of aperture 128 is moved into alignment with transverse hole 112, and thus in registry with shank portion 138 of pivot pin 76. Enlarged portion 132 is dimensioned such that it is slightly larger than shank portion 138 of pivot pin 76, and it will be seen by those skilled in the art that once in this unlocked position, actuation plate 116, and therefore handle assembly 78, are free to pivot about pivot pin 76. This is more clearly understood by referring first to FIG. 3, in which the apparatus is shown in the locked position. When button 126 is depressed, handle assembly 78 may be moved in a counterclockwise direction to an unlocked position as shown in FIG. 4. As this pivotation of handle assembly 78 about pivot pin 76 occurs, clamp assembly 80 is pivoted in a clockwise direction about pivot pin 84 because of the interaction of links 94 between handle assembly 78 and the clamp assembly. Thus, clamp assembly 80 is moved to a raised, unclamped position in which clamp plate 88 is spaced from and free of the wheel of the wheelchair, so that the wheel may be rolled onto or off of the rails.

Once handle assembly 70 is pivoted toward the unlocked position of FIG. 4, it will be seen that a part of enlarged portion 138 of aperture 128 is caused by the biasing force of spring 154 to bear against shank portion 138 of pivot pin 76. In other words, actuation plate 116, button 126 and sleeve 128 are held in their innermost, unlocked position and cannot return to their outermost, locked position when handle 78 is so pivoted. However, in reclamping the apparatus by pivoting handle assembly 78 in a clockwise direction as shown in FIG. 4, once elongated portion 130 of aperture 128 in actuation plate 116 is realigned with flat surfaces 148 on shank portion 138 of pivot pin 76, spring 142 will act to return actuation plate 116, button 126 and sleeve 128 to the locked position with a quick, spring actuated motion. Thus, handle assembly 78 will automatically relock when clamping mechanism 10 is moved to the clamping position shown in FIG. 3.

A stop pin 160 is fixedly attached to portion 72 of L-shaped member 70 by fastener means, such as nuts 162, as best shown in FIG. 5. Referring again to FIG. 3, it will be seen that stop pin 160 will act to limit movement of handle assembly 78 in a clockwise direction. In this way, if additional force is applied to handle assembly 78 in a clockwise direction once the handle assembly is locked, this additional force will be transmitted to stop pin 160 and not absorbed solely by pivot pin 76 so that wear on the pivot pin and actuation plate 116, or potential damage thereto, is minimized.

Sleeve 128 is dimensioned such that a portion thereof always extends into central cavity 102 regardless of the position of the sleeve as a function of the position of actuation plate 116. Sleeve 128 is also dimensioned to closely fit within central cavity 102 so that the possibility of entry of dust into handle assembly 78 through open end 106 is minimized. Also, this allows lubication of the elements within handle assembly 78 while reducing the likelihood of the lubricant escaping through open end 106. Likewise, shank portion 138 of pivot pin 76 is dimensioned to closely fit within transverse hole 112 to minimize the entry of dirt and the escape of lubricant. If desired, any sealing means known in the art may be used in any of these areas.

A resilient member or ring 164 is preferably positioned between head portion 144 of pivot pin 76 and the outer edge of collar 110 in handle assembly 78. Ring 164 is designed to act as a friction clutch means so that a predetermined amount of resistance is always provided during pivotation of handle assemby 78. This gives a tight feel to the operation of the apparatus and serves to reduce the possibility of undesired movement of handle assembly 78 when the handle assembly is not in its locked position. Further, during transit, rattling of the components is also minimized by ring 164.

Figure 9:
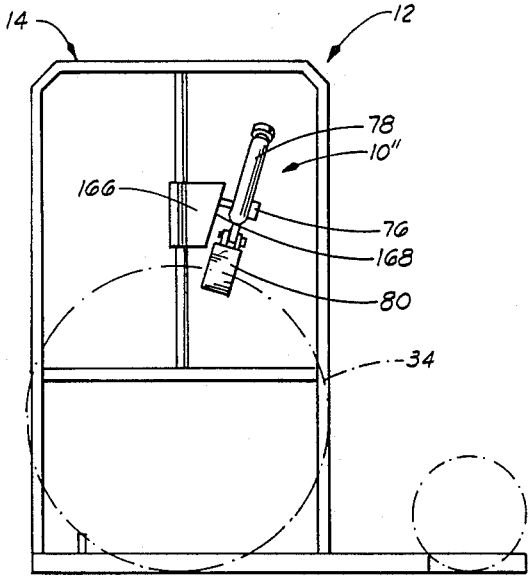
FIG. 9 shows an alternate embodiment of the clamping mechanism as used as part of a wheelchair clamping and loading rack.

Referring now to FIG. 9, an alternate embodiment of the claming mechanism of the present invention, generally designed by the numeral 10'', is shown attached to frame 14, again forming a portion of a wheelchair clamping and holding rack assembly 12. In this embodiment, a mounting bracket 166, having an angled member 168 is used. Handle assembly 78 is again pivotally mounted to pivot in 76 in a manner identical to the first embodiment. Preferably, angled member 168 radially positions clamp assembly 80 with respect to wheel 34 such that the clamp assembly is aligned with a center point of the wheel. Thus, more even loading by clamp assembly 80 is applied to the outer edge of wheel 34. Other than this angular displacement clamping mechanism 10'' operates in precisely the same manner as the above-described embodiment 10.

Figure 10:
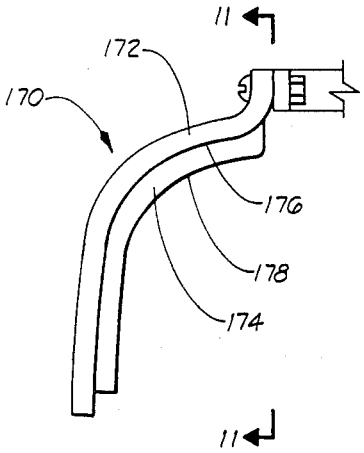
FIG. 10 is a detailed side view of an alternate embodiment of the clamping member of the clamping mechanism.
Figure 11:
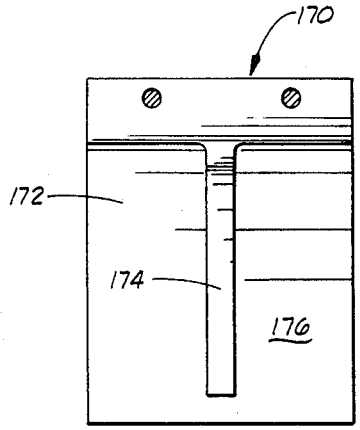
FIG. 11 is a view taken along lines 11—11 in FIG. 10.

Referring now to FIGS. 10 and 11, an alternate clamp assembly 170 is shown having a clamp plate 172 with a raised elongated rib 174 on an inner surface 176 thereof. Rib 174 extends generally longitudinally along clamp plate 172 and has a curvilinear inner edge 178 which will be seen by those skilled in the art to be the point of contact on the wheel of the wheelchair when the apparatus is in the clamping position. Rib 174 is centrally located in a transverse direction on clamp plate 172. In this embodiment, the reduced area of contact on the wheel of the wheelchair causes the tire on the wheel to be slightly depressed, thus increasing the securing force applied thereto. The actual geometric shape of clamping plate 88 in clamp assembly 80 or rib 174 in clamp assembly 170 may be varied to fit the particular shape and size of the object to be clamped thereby.

It will be seen, therefore, that the clamping mechanism of the present invention is well adapted to carry out the objects and obtain the ends and advantages mentioned, as well as those inherent therein. While several presently preferred embodiments of the invention have been described for the purposes of this disclosure, numerous changes in the construction and arrangement of parts may be made by those skilled in the art. In particular, while the clamping mechanism has been described for use on a wheelchair loader, it will be obvious that such a clamping mechanism may be used in any situation where it is desirable to clamp an object to a structural element. Examples include, but are not intended to be limited to, a wheelchair brake or a clamp for a machine tool. All such changes in the construction and use of the apparatus are encompassed within the scope and spirit of the invention as defined by the appended claims.

What is claimed is:

1. A clamping apparatus for clamping an object to a structure, said apparatus comprising:

mounting means for attaching to a portion of said structure;

pivot means for attaching to said mounting means;

lever means pivotally mounted on said pivot means for pivoting with respect to said mounting means, one of said pivot means and lever means comprising key means thereon, and the other of said pivot means and lever means comprising keyway means thereon, said key means and keyway means being adapted for mutually engaging one another, one of said key means and keyway means being movable with respect to the other between a locked position and an unlocked position allowing relative rotation therebetween such that said lever means may be pivoted between first and second positions;

object engaging means pivotally attached to said mounting means for engaging said object when in clamped position and disengaging said object when in an unclamped position; and a link interconnecting said lever means and said object engaging means for moving said object engaging means between said clamping position and said unclamped position as said lever means is pivoted between said first position and said second position.

2. The clamping mechanism of claim 1 further comprising biasing means for biasing the movable one of said key means and keyway means toward said locked position.

3. A clamping apparatus for clamping an object to a structure, said apparatus comprising:

mounting means for attaching to a portion of said structure;

lever means for pivoting with respect to said mounting means and comprising:

a hollow handle defining a transverse hole therethrough; and a plate reciprocably positioned in said handle and defining a substantially keyhole-shaped opening in a portion thereof adjacent said transverse hole, said opening having:

an elongated portion; and an enlarged portion;

pivot means for attaching to said mounting means and for allowing pivotal mounting of said lever means on said pivot means, said pivot means comprising a pivot pin extending through said transverse hole in said handle and fixedly attached to said mounting means, said pivot pin further having a flat surface thereon, wherein said flat surface engages said elongated portion of said opening when in a locked position and is disposed in said enlarged portion of said opening when in an unlocked position;

object engaging means pivotally attached to said mounting means for engaging said object when in a clamping position and disengaging said object when in an unclamped position; and linkage means interconnecting said lever means and said object means for moving said object engaging means between said clamping position and said unclamped position as said lever means is pivoted between a first position and a second position.

4. A clamping and loading rack for a wheelchair loader, said rack comprising:

a support frame having an intermediate member;

a wheel rail attached to a lower end of said frame for receiving at least one wheel of a wheelchair;

a stop plate for limiting movement of said wheel on said rail such that said wheel is positionable adjacent said frame, said stop plate being disposed on one side of a vertical center line of said wheel; and a clamping mechanism positioned on an opposite side of said vertical center line of said wheel from said stop plate and comprising:

a mounting bracket variable attachable to said intermediate member of support frame;

a pivot pin affixed to said mounting bracket and comprising a key portion;

a handle assembly pivotally mounted on said pivot pin and having a lockable first position and pivotable to a second position, said handle assembly comprising:

an elongated tubular handle defining a longitudinally central cavity therein opening at one end thereof and a transverse hole therethrough intersecting said central cavity, through which said pivot pin is disposed; and an elongated plate defining an aperture therethrough having a keyway portion and an enlarged portion, said plate being reciprocably disposed in said central opening of said handle and pivotable with said handle such that said pivot pin extends through said aperture, said plate further having a locked position corresponding to said first position of said handle assembly in which said key portion is in locking engagement with said keyway portion of said aperture for preventing pivotation of said plate and handle and an unlocked position corresponding to said second position of said handle assembly in which said pivot in is in registry with said enlarged portion of said aperture for allowing pivotation of said plate and said handle about said pivot pin; and a clamp engaged with said wheel and holding the wheel in a clamped position against said frame when said handle assembly is in said first position and spaced from and free of said wheel when said handle assembly is in said second position.

5. A clamping apparatus for clamping an object to a structure, said apparatus comprising:

mounting means for attaching to a portion of said structure;

a lever and pivot assembly comprising:

an elongated tubular handle defining a longitudinally central cavity therein with an open end and having a transverse hole therethrough intersecting said central cavity;

a pivot pin disposed through said transverse hole in said handle and having a key portion thereon, said pivot pin being fixedly attached to said mounting means such that said handle may be pivoted around said pivot pin between said first and second positions; and an elongated plate defining an aperture therethrough having a keyway portion and an enlarged portion, said plate being reciprocably disposed in said central opening of said handle and pivotable with said handle such that said pivot pin extends through said aperture, said plate further having a locked position in which said key portion of said pivot pin is in locking engagement with said keyway portion of said aperture for preventing pivotation of said plate and handle and an unlocked position in which said pivot pin is in registry with said enlarged portion of said aperture for allowing pivotation of said plate and handle; and a clamping member connected to said mounting means and lever and pivot assembly such that said clamping member is moved between a position clamping said object to said structure and a position spaced from said object as said handle is pivoted between said first and second positions.

6. The apparatus of claim 5 further comprising biasing means for biasing said plate from said unlocked position toward said locked position.

7. The apparatus of claim 6 wherein said biasing means includes a spring and further comprising a seat in said central opening of said handle for receiving an end of said spring.

8. The apparatus of claim 7 wherein said seat comprises a pin extending inwardly from a wall of said handle.

9. The apparatus of claim 5 wherein said pivot pin has an enlarged head portion disposed adjacent an external side of said handle opposite said mounting means.

10. The apparatus of claim 9 further comprising an annular elastomeric member disposed between said head portion of said pivot pin and said external side of said handle.

11. The apparatus of claim 5 wherein said plate has a button attached thereto, said button extending outwardly from said open end of said central cavity of said handle.

12. The apparatus of claim 5 further comprising plate positioning means for locating said plate at a substantially transversely central position in said central cavity of said handle.

13. The apparatus of claim 12 wherein said plate positioning means comprises a pair of oppositely disposed collars extending inwardly from opposite walls of said handles such that a gap is defined therebetween for receiving a portion of said plate therethrough.

14. A clamping apparatus for clamping a wheelchair wheel to a wheelchair loading rack, said apparatus comprising:

a mounting bracket attachable to a portion of said rack;

a handle assembly adjacent said mounting bracket and comprising:

an elongated tubular handle defining a longitudinally central cavity therein with an open end, said tubular handle having a pair of inwardly extending substantially cylindrical collar members forming a gap therebetween and defining a transverse hole through said handle in communication with said central cavity;

an elongated, substantially flat actuation plate reciprocably disposed in said central cavity of said handle and comprising:

a first portion, at least a part of which is disposed through said gap between said collar members, and having edges in close spaced relationship to an inner surface of said handle, said first portion defining a substantially keyhole-shaped aperture therethrough adjacent said transverse opening, said aperture having a rounded portion and an elongated portion with spaced, longitudinally parallel edges and a bottom edge; and a second portion, relatively narrower than said first portion, relatively narrower than said first portion, having an end extending from said open end of said central cavity of said handle;

a button attached to said end of said second portion of said plate;

a seat fixedly positioned in said handle at a longitudinally intermediate location between said open end of said central cavity and said transverse hole; and a spring disposed around said second portion of said plate and between said seat and button for biasing said actuation plate and button in a longitudinal direction away from said seat;

a pivot bolt comprising:

a head portion adjacent an outer surface of one of said collar members and opposite said mounting bracket;

a substantially cylindrical shank portion extending from said head portion and through said transverse opening in said handle and said aperture in said first portion of said plate, said shank portion defining at least one flat surface thereon; and an end portion extending from said shank portion and fixedly attached to said mounting bracket;

wherein:

when said plate is in an outermost position, a longitudinal edge of said elongated portion of said aperture is in locking engagement with said flat surface on said shank portion of said pivot bolt such that pivotation of said plate and said handle around said pivot bolt is prevented and said handle assembly is thereby held in a locked position; and when said plate is moved to an innermost position by depressing said button, said rounded portion of said aperture is registered with said shank portion of said pivot bolt, such that said plate and handle may be pivoted with respect to said pivot bolt so that said handle assembly may be moved to an unlocked position;

a clamp pivotably attached to said mounting bracket and having a clamping position engaging said wheel and a free position spaced from said wheel; and linkage means for interconnecting said handle assembly and said clamp, such that when said handle assembly is in said locked position said clamp is held in said clamping position, and when said handle assembly is pivoted to said unlocked position said clamp is pivoted to said free position.

15. The apparatus of clamp 14 further comprising a stop limiting maximum pivotation of said handle assembly.

16. The apparatus of claim 14 further comprising a resilient member between said head portion of said pivot bolt and said collar member adjacent thereto.

17. The apparatus of claim 14 further comprising a sleeve adjacent said button and movable therewith, said sleeve extending into said open end of said central cavity of said handle when said plate is in said outermost position.

18. The apparatus of claim 14 wherein said bracket includes a pair of opposite, substantially U-shaped members positionable around said portion of said rack.

19. The apparatus of claim 14 wherein said claim comprises a raised ridge thereon engageable with said wheel when in said clamping position.

20. The apparatus of claim 14 wherein said claim has a curvilinear portion corresponding to an edge of said wheel and engageable therewith when in said clamping position.

21. The apparatus of claim 14 wherein said clamp is angled for alignment with a center point of said wheel.

22. A clamping and loading rack for a wheelchair loader, said rack comprising:

a support frame having an intermediate member;

a wheel rail attached to a lower end of said frame for receiving at least one wheel of a wheelchair;

a stop plate for limiting movement of said wheel on said rail such that said wheel is positionable adjacent said frame, said stop plate being disposed on one side of a vertical center line of said wheel; and a clamping mechanism positioned on an opposite side of said vertical center line of said wheel from said stop plate and comprising:

a mounting bracket variable attachable to said intermediate member of said support frame;

a pivot pin affixed to said mounting bracket;

a handle assembly pivotally mounted on said pivot pin and having a lockable first position and pivotable to a second position; and a clamp engaged with said wheel and holding the wheel in a clamped position against said frame when said handle assembly is in said first position and spaced from and free of said wheel when said handle assembly is in said second position.

23. The rack of claim 22 wherein said intermediate member is a centrally positioned vertical member.

24. The apparatus of claim 22 wherein said clamping mechanism is angularly disposed with respect to said intermediate member such that said clamp is aligned with a center point of said wheel.

25. The apparatus of claim 22 wherein said clamping mechanism is positioned on an opposite side of a horizontal center line of said wheel from said rail.

26. A clamping apparatus for clamping an object to a structure, said apparatus comprising:

mounting means for attaching to a portion of said structure;

pivot means for attaching said mounting means;

lever means pivotally mounted on said pivot means for pivoting with respect to said mounting means, one of said pivot means and lever means comprising key means thereon, and the other of said pivot means and lever means comprising keyway means thereon, said key means and keyway means being adapted for mutually engaging one another, one of said key means and keyway means being movable with respect to the other between a locked position and an unlocked position allowing relative rotation therebetween such that lever means may be pivoted between first and second positions;

object engaging means pivotally attached to said mounting means for engaging said object when in a clamping position and disengaging said object when in an unclamped position;

linkage means interconnecting said lever means and said object engaging means for moving said object engaging means between said clamping position and said unclamped position as said lever means is pivoted between said first position and said second position; and friction clutch means in operative association with said lever means and pivot means for providing frictional resistance therebetween as said lever means is pivoted.

* * * * *

UNITED STATES PATENT AND TRADEMARK OFFICE

CERTIFICATE OF CORRECTION

PATENT NO. : 4,772,164

DATED : September 20, 1988

INVENTOR(S) : Robert E. McFarland

It is certified that error appears in the above-identified patent and that said Letters Patent are hereby corrected as shown below:

Title page, under "Related U.S. Application Data", delete "4,658,971" and insert --4,685,860-- therefor.

Column 1, line 6, delete "4,658,971" and insert --4,685,860-- therefor.

Column 5, line 21, delete "pivotably" and insert --pivotally-- therefor; lines 28 and 29, delete "transversey" and insert --transversely-- therefor; line 30, delete "it" and insert --is-- therefor; line 34, delete "elongate" and insert --elongated-- therefor; line 47, delete "an" and insert --and-- therefor.

Column 8, line 15, delete "claming" and insert --clamping-- therefor; line 21, delete "in" and insert --pin-- therefor; line 27, after "displacement" and before "clamping" insert --,--.

Claim 1, line 20, delete "clamped" and insert --a clamping-- therefor.

Claim 4, line 13, delete "variable" and insert --variably-- therefor; line 39, delete "in" and insert --pin-- therefor.

Claim 19, line 1, delete "claim", second occurrence, and insert --clamp-- therefor.

Claim 20, line 1, delete "claim", second occurrence, and insert --clamp-- therefor.

Claim 22, line 13, delete "variable" and insert --variably-- therefor.

UNITED STATES PATENT AND TRADEMARK OFFICE

CERTIFICATE OF CORRECTION

PATENT NO. : 4,772,164

DATED : September 20, 1988

INVENTOR(S) : Robert E. McFarland

It is certified that error appears in the above-identified patent and that said Letters Patent are hereby corrected as shown below:

Claim 26, line 16, after "that" and before "lever", insert --said--.

Signed and Sealed this

Thirty-first Day of January, 1989

*Attest:*

DONALD J. QUIGG

*Attesting Officer*

*Commissioner of Patents and Trademarks*